US005684462A

United States Patent [19]

Gold

[11] Patent Number: 5,684,462

[45] Date of Patent: Nov. 4, 1997

[54] DRIVER ATTENTION ALARM

[76] Inventor: Bert Joseph Gold, 310 W. 55th St., New York, N.Y. 10019

[21] Appl. No.: 586,223

[22] Filed: Jan. 16, 1996

[51] Int. Cl.[6] ..... G08B 23/00

[52] U.S. Cl. ..... 340/576; 340/439; 340/575; 340/309.3; 340/309.4; 180/272

[58] Field of Search ..... 340/439, 575, 340/576, 309.15, 309.13, 309.4; 180/272

[56] References Cited

U.S. PATENT DOCUMENTS

| | | | |
|---|---|---|---|
| 3,559,205 | 1/1971 | Colby | 340/575 |
| 4,005,398 | 1/1977 | Inoue et al. | 340/579 |
| 4,017,843 | 4/1977 | Yanagishima | 340/579 |
| 4,234,051 | 11/1980 | Morris, Jr. | 340/575 |
| 4,348,663 | 9/1982 | Yanagishima et al. | 340/576 |
| 4,359,725 | 11/1982 | Balogh et al. | 340/579 |
| 4,496,938 | 1/1985 | Seko et al. | 340/576 |
| 4,616,208 | 10/1986 | Nakamura | 340/309.15 |
| 5,012,226 | 4/1991 | Love | 340/576 |
| 5,392,030 | 2/1995 | Adams | 340/576 |
| 5,402,108 | 3/1995 | Tabin et al. | 340/439 |

*Primary Examiner*—Jeffery Hofsass
*Assistant Examiner*—Daniel J. Wu

[57] ABSTRACT

The invention is characterized by a box adapted for mounting on the dashboard of a motor vehicle containing an electrical circuit connected to the vehicle electrical system. The circuit activates sequentially two alarms, first a visual display, then an audio alarm. The alarm is activated by a random timer which is capable of recycling when a deactivating bar is depressed. A series of five time intervals are capable of determining the time interval between recycling periods of the random timer.

7 Claims, 2 Drawing Sheets

DRIVER ATTENTION ALARM

BACKGROUND OF THE INVENTION

1. Field of the Invention

This invention relates generally to field of alarms and in particular to alarms to aid drowsy drivers.

2. The Problem and Relevant Prior Art

One of the nations most serious driving problems is drivers who for one reason or another become drowsy and nod off while travelling on the highway at high rates of speed. Sometimes the driver is the victim of sleep deprivation and other times drowsiness is caused by extended boredom on a long trip on the Interstate highways. Regardless of the cause, the driver develops tunnel vision and loses sense perception and begins to weave and gradually lose control of the vehicle. The driver is unable to respond to emergencies and dangerous situations. There are a substantial number of serious accidents caused each year by drivers who are sleepy or otherwise lose alertness.

This problem has been recognized for some time and there have been various attempts made to force the driver to recognize his problem and other attempts to simply continuously signal the and effectively attract the drivers attention back to the road. For example U.S. patents issued relating to driver alertness include: U.S. Pat. No. 4,017,843 issued Apr. 12, 1977 to Yanagishima and assigned to the Nissan Motor Co. Ltd. for a vehicle drive alertness apparatus monitoring steering wheel oscillations using a computer counting system; U.S. Pat. No. 4,005,398 issued Jan. 25, 1977 to Inoue et al. is also assigned to the Nissan Motor Co. Ltd. for a method of determining the driver's sufficient alertness to drive a motor vehicle safely using computer aided apparatus; U.S. Pat. No. 4,359,725 issued Nov. 16, 1982 to Balogh et al. discloses a complicated and sophisticated method and apparatus for monitoring the alertness of the driver of a vehicle, based upon the electric power consumption of a vehicle which is monitored and if unchanged for a selected period of time, the system sends a signal to the driver who must respond, if there is no response or inaccurate response warning apparatus is activated; U.S. Pat. No. 5,012,226 issued Apr. 30, 1991 to Love discloses a safety alertness monitoring system which uses a series of lights to warn the driver in the event he fails to actuate a switching means to reset a timer, and U.S. Pat. No. 5,392,030 issued Feb. 21, 1995 for a locomotive personal alert system which is a device to determine if a driver is in a condition to operate a vehicle.

The instant invention as disclosed and claimed herein provides distinct and useful advantages not previously known to the prior art.

SUMMARY OF THE INVENTION

The invention is characterized by an audio-visual alarm that will alert a drowsy or fatigued operator of a vehicle that his attention and alertness is diminished. The alarm of the invention is designed to rest in a conspicuous place in the vehicle, preferably on the dashboard where it is convenient to obtain electrical power from the cigar lighter. The alarm is contained in a box slightly larger than a package of cigarettes. The box contains an on-off switch, a variable timer and a preset timer as well as a light for visual warning and a audio alarm for a sound warning. In addition a driver controlled cycling switch is added to allow the driver to increase or decrease the time between random cycles of the alarm. The key to the invention is a spring biased recycling bar mounted on the box that resets the timer circuit. If the recycling bar is not activated within a selected period an alarm activates and causes the driver intense annoyance and aggravation thus awaking him and drawing his attention back to the road.

It is therefore an object of the invention to provide a new and improved driver attention alarm.

It is another object of the invention to provide a new and improved driver attention alarm that is portable from vehicle to vehicle.

It is a further object of the invention to provide a new and improved driver attention alarm that is simple to operate.

It is still another object of the invention to provide a new and improved driver attention alarm that has all the advantages of similar prior art like devices and none of the disadvantages.

It is still a further object of the invention to provide a new and improved driver attention alarm which is easily and efficiently manufactured and marketed.

It is another object of the invention to provide a new and improved driver attention alarm which is susceptible of a low cost of manufacture with regard to both materials and labor and which accordingly is then susceptible of low prices of sale to the consuming public, thereby making such board game apparatus economically available to the buying public.

These, together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF A PREFERRED EMBODIMENT

Figure 1:
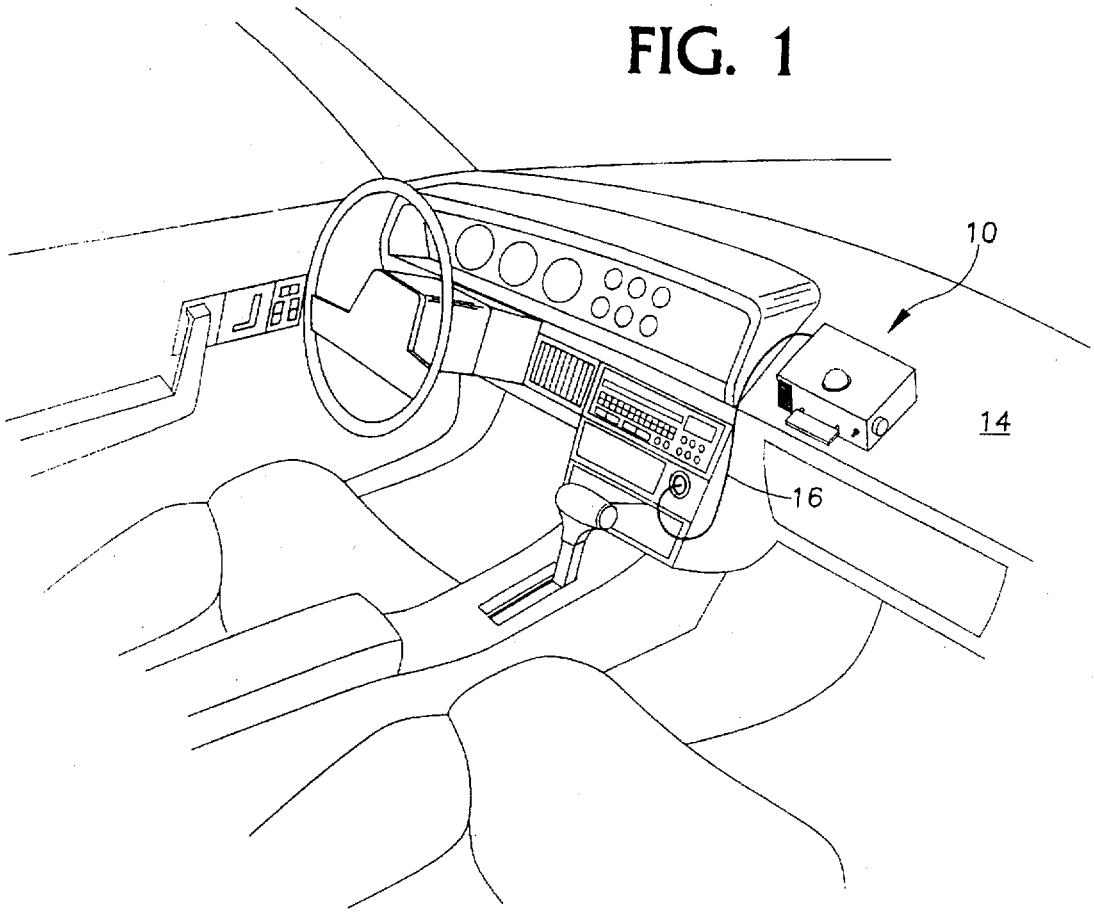
FIG. 1 is an environmental view of the invention.
Figure 2:
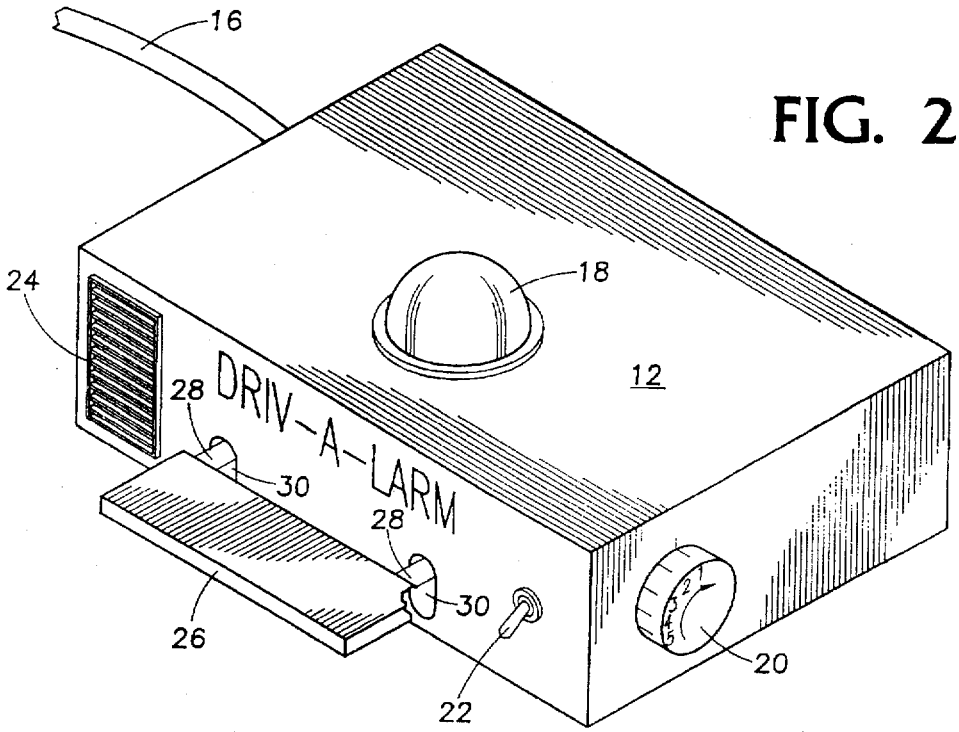
FIG. 2 is a perspective view of the invention.

Referring now to FIGS. 1 and 2, the invention is shown generally at 10, a container 12 of plastic or other suitable material contains the system of the alarm. The container is mounted appropriately on the dashboard 14 of a vehicle, in a location within reach of the operator of the vehicle and sufficiently close to an electrical source where the power cord 16 may be conveniently connected.

Visible on the outside of the container is a light 18 mounted of the top side and used to initially warn the operator that the system is in phase one activation mode. The light is sufficiently bright and flashing to attract the attention of the driver but not so distracting as to cause confusion in the drivers mind and cause an accident. On the right side of the container is a rotating switch 20 containing five detentes each of which controls the time period between the cycling of the random mode alarm system. If the driver is only slightly inattentive he will use step one or if he is very fatigued and drowsy he will use step five which will decrease the time between alarm cycles.

The front face of the container is an on-off power toggle switch 22 which controls the electrical current from the power cord 16. A louvered vent 24 in the front panel is the outlet for a sound alarm positioned within the container directly behind the vent. A recycling bar 26 is hinged to the front interior surface of the container and is spring biased in the horizontal position. It's preferential coloring is red and is connected to a recycling circuit by one of the mounting poles 28. The apertures 30 through which the poles pass are elongated thereby allowing the bar to be depressed without damaging the front of the container.

In operation, the driver powers on the alarm which is plugged into the dashboard of the vehicle, and then determines his fatigue factor and sets the cycle mode timer 20. As the driver proceeds down the road after a random period of time the flashing light 18 will activate and driver is warned to depress the recycle bar 26. If the bar is not depressed in a predetermined time, such as six seconds, a loud, harsh audio alarm will sound and continue until the driver depresses the recycle bar 26. The random cycle is selected to be between thirty seconds and two and one half minutes.

Figure 3:
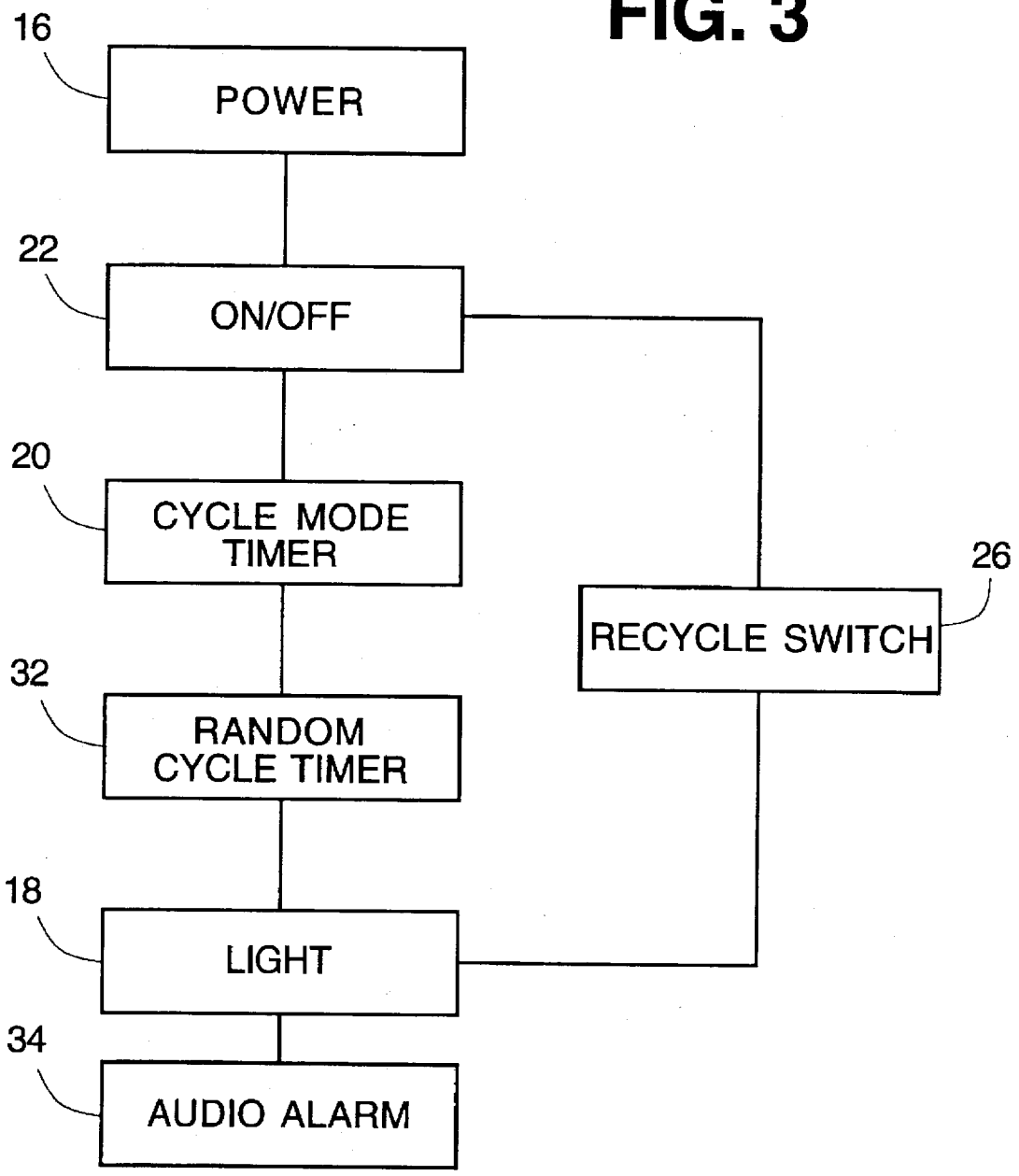
FIG. 3 is a schematic block diagram of the invention.

Concerning FIG. 3, power 16 enters the circuit through on-off switch 22 and is sent to the cycle mode timer switch 20. The cycle mode timer sets the interval between the cycles of the random cycle timer 32. At the end of a cycle of the random timer the light 18 is activated and begins to flash. Random cycle timer continue to count for six seconds and unless recycled the audio alarm 34 is activated. The only means to deactivate the audio and light are recycling bar 26 or system on-off switch 22.

The parts used in the invention are conventional items available off the shelf at wholesale and retail outlets.

It should be understood, of course, that the foregoing disclosure relates to only a preferred embodiment of the invention and that numerous modifications of alterations may be made therein without departing from the spirit and scope of the invention as set forth in the appended claims.

What is claimed is:

1. A driver attention alarm comprising:

an enclosure having four walls and a top and bottom;

an electrical circuit positioned within the enclosure;

a source of electrical power applied to the electrical circuit;

a means for controlling the power into the circuit;

a first alarm means activated by the electrical circuit to attract a drivers attention;

a random timer circuit connected to the source of electrical power for activating the first alarm means;

an adjustable timer circuit connected between the source of electrical power and the random timer circuit for selectively controlling the time between activation of the random timer circuit;

a second alarm means connected to the random cycle timer to attract a drivers attention after a preset period of time, and a means for recycling the random timer circuit after the first alarm is activated, whereby the random timer will deactivate the alarms and renew its cycle.

2. A driver attention alarm according to claim 1 wherein: the means for controlling the power into the circuit is a toggle switch.

3. A driver attention alarm according to claim 2 wherein: the first alarm means is a light.

4. A driver attention alarm according to claim 3 wherein: the first alarm means is a flashing light.

5. A driver attention alarm according to claim 4 wherein: the adjustable timer circuit includes five degrees of selectivity.

6. A driver attention alarm according to claim 5 wherein: the second alarm is an audio alarm.

7. A driver attention alarm according to claim 5 wherein: the means for recycling the random timer circuit is actuated by a bar mounted on the outside of the container, whereby depression of the bar by the driver will cause the random timer to recycle and deactivate the alarms.

* * * * *